US007745383B2

(12) United States Patent
Dreja et al.

(10) Patent No.: US 7,745,383 B2
(45) Date of Patent: Jun. 29, 2010

(54) METHOD FOR CLEANING HARD SURFACES USING A COMPOSITION COMPRISING A COLLOIDAL SILICA SOL

(75) Inventors: Michael Dreja, Scottsdale, AZ (US); Juergen Noglich, Duesseldorf (DE); Bernhard Guckenbiehl, Cologne (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 11/151,635

(22) Filed: Jun. 13, 2005

(65) Prior Publication Data

US 2005/0239674 A1 Oct. 27, 2005

Related U.S. Application Data

(63) Continuation of application No. PCT/EP03/14203, filed on Dec. 13, 2003.

(30) Foreign Application Priority Data

Dec. 17, 2002 (DE) ..... 102 58 831

(51) Int. Cl.
*C11D 3/08* (2006.01)
*C11D 1/83* (2006.01)
*C11D 3/30* (2006.01)

(52) U.S. Cl. ..... 510/180; 510/163; 510/238; 510/422; 510/435; 510/460; 510/511

(58) Field of Classification Search ..... 510/163, 510/180, 238, 422, 435, 460, 511
See application file for complete search history.

(56) References Cited

U.S. PATENT DOCUMENTS

| | | | | | |
|---|---|---|---|---|---|
| 3,899,447 | A * | 8/1975 | McDonald | 510/418 |
| 4,100,093 | A | 7/1978 | Rialdi | |
| 4,101,457 | A * | 7/1978 | Place et al. | 510/226 |
| 4,124,523 | A * | 11/1978 | Johnson | 510/398 |
| 4,145,184 | A * | 3/1979 | Brain et al. | 8/137 |
| 4,391,765 | A * | 7/1983 | Lee et al. | 264/418 |
| 4,611,892 | A * | 9/1986 | Kawashima et al. | 351/159 |
| 4,650,527 | A * | 3/1987 | Ishii et al. | 148/251 |
| 4,971,631 | A * | 11/1990 | Sallee et al. | 510/100 |
| 5,431,852 | A * | 7/1995 | Kaijou | 516/55 |
| 5,753,740 | A * | 5/1998 | Odawa et al. | 524/414 |
| 5,873,931 | A * | 2/1999 | Scholz et al. | 100/13 |
| 5,895,781 | A * | 4/1999 | Neumiller et al. | 510/238 |
| 5,972,087 | A * | 10/1999 | Uraki et al. | 106/31.65 |
| 6,294,262 | B1 * | 9/2001 | Fukuoka | 428/472 |
| 6,740,629 | B2 * | 5/2004 | Ando et al. | 510/245 |
| 6,784,149 | B2 * | 8/2004 | Bauer et al. | 510/334 |
| 7,005,382 | B2 * | 2/2006 | Nishimoto et al. | 438/690 |
| 2002/0045010 | A1 | 4/2002 | Rohrbaugh et al. | |
| 2003/0121530 | A1 * | 7/2003 | Borgonjon et al. | 134/6 |
| 2003/0217989 | A1 * | 11/2003 | Benning et al. | 216/41 |
| 2004/0023824 | A1 | 2/2004 | Zuechner et al. | |

FOREIGN PATENT DOCUMENTS

| | | | |
|---|---|---|---|
| DE | 199 52 383 | A1 | 5/2001 |
| DE | 100 21 726 | A1 | 11/2001 |
| EP | 1 215 276 | A1 | 6/2002 |
| JP | 55 007840 | | 1/1980 |
| JP | 60 060197 | | 4/1985 |
| JP | 60 133100 | | 7/1985 |
| JP | 08 302394 | | 11/1996 |
| WO | WO 97/38076 | A1 | 10/1997 |

OTHER PUBLICATIONS

Database WPI, Section Ch Week 198009, Derwent Publications Ltd., London, GB; AN 1980-15532C XP002276135 for JP 55007840 Jan. 21, 1980.*
Database WPI, Section Ch, Week 199705, Derwent Publications Ltd., London, GB; AN 1997-048704 XP002276137 for JP 08 302394 Nov. 19, 1996.*
Database WPI, Section Ch, Week 198534, Derwent Publications Ltd., London, GB; AN 1985-207860 XP002276136 for JP 60 133100 Jul. 16, 1985.*
Database WPI, Section Ch, Week 198009, Derwent Publications Ltd., London, GB; AN 1980-15532C XP002276135 for JP 55007840 (Jan. 21, 1980).
Database WPI, Section Ch, Week 198534, Derwent Publications Ltd., London, GB; AN 1985-207860 XP002276136 for JP 60 133100 (Jul. 16, 1985).
Database WPI, Section Ch, Week 199705, Derwent Publications Ltd., London, GB; AN 1997-048704 XP002276137 for JP 08 302394 (Nov. 19, 1996).
Database WPI, Section Ch, Week 198520, Derwent Publications Ltd., London, GB; AN 1985-119732 XP002276138 for JP60 060197 (Apr. 16, 1985).
International Cosmetic Ingredient Dictionary and Handbook, 7th Edition (1997).

* cited by examiner

*Primary Examiner*—Charles I Boyer
(74) *Attorney, Agent, or Firm*—David P. LeCroy

(57) ABSTRACT

Cleaner for hard surfaces, especially glass. Application of the cleaner containing a colloidal silica sol results in a modification of the streaming potential of the surface by −5 to −50 mV. The cleaner can be used to hydrophilize and clean hard surfaces by contact.

18 Claims, No Drawings

METHOD FOR CLEANING HARD SURFACES USING A COMPOSITION COMPRISING A COLLOIDAL SILICA SOL

CROSS REFERENCE TO RELATED APPLICATIONS

This application is a continuation under 35 U.S.C. §356(c) and 35 U.S.C. §120 of international application PCT/EP2003/014203, filed Dec. 13, 2003. This application also claims priority under 35 U.S.C. §119 of DE 102 58 831.7, filed Dec. 17, 2002, which is incorporated herein by reference in its entirety.

BACKGROUND OF THE INVENTION

The invention relates to aqueous liquid surfactant-containing cleaning compositions for hard surfaces, especially glass, which comprise a colloidal silica sol and whose use increases the negative charge of the surface.

The cleaning of hard surfaces and especially the cleaning of glass has not only the hygienic aspect but also an esthetic side. It is thus desirable that a clean surface dries very rapidly and uniformly in order to avoid the formation of unappealing drop- or streaklike residues ("runs") if possible. However, these can form not only after the cleaning, especially in the case of use of hard water, but also between the cleaning operations when the surface again comes into contact with water, known as the rain effect. For example, this is the case in bathrooms, but in particular for surfaces exposed to the weather, such as windows etc. The rapid drying of the surfaces is therefore generally desirable. It is further advantageous when the surface is wetted over the full surface for a prolonged period instead of the film breaking, which likewise leads to "runs". The full-surface wetting with a thin film likewise contributes to rapid drying; in addition, tiny soil particles are distributed uniformly instead of occurring concentrated in the "runs", so that the surface has a visually cleaner appearance. A further aspect, again in particular for surfaces exposed to the weather, is the reduction of the resoiling tendency of clean surfaces, since it is desirable for the consumer to allow a maximum period of time between two cleaning operations without the surface appearing dirty to the observer. In addition, an anticondensation action is desirable to minimize the condensation of water on the surface. In order to satisfy all of these requirements, the cleaner should modify the surface to be cleaned in such a way that the wetting behavior changes compared to an untreated surface, so that it is soiled less rapidly and dries rapidly without the formation of "runs".

The European application EP 1 215 276 (Clariant) describes laundry detergents and cleaning compositions which comprise microdisperse silicate-containing particles. These may be colloidal silica sols. These particles are intended to act as surface coating compositions and to lead to improved soil detachment with simultaneous reduction of the resoiling tendency. No statement is made about a further-reaching change in the surface properties or about an antirain/anticondensation action.

DE 199 52 383 A1 (Henkel) likewise describes laundry detergents and cleaning compositions which can impart soil-repellent properties temporarily to a surface to be cleaned by virtue of the particles having a particle size of from 5 to 500 nm which are present. The particles used here may also be $SiO_2$ sols among others. The nanoscale particles lead to an increase in the wettability of the substrates to be cleaned. In this case too, there is likewise no statement about a further-reaching change in the surface properties, nor about any antirain or anticondensation action.

The published patent application DE 100 21 726 A1 (Henkel) provides for the use of nanoscale particles for the improvement of the soil detachment and or reduction of the resoilability, in particular of textile but also of hard surfaces. The particles used may again be $SiO_2$ sols. The particles bring about an increase in the hydrophilicity of the surface and the structuring of the surface, although the latter point is not explained in detail. Neither further changes in the surface properties nor any antirain or anticondensation action are described.

The patent application U.S. 2002/0045010 A1 (Procter & Gamble) finally describes compositions which comprise a nanoparticle system and may be used for surface modification on all hard surfaces. The surface modification may bring about properties including one or more of the following: wetting, film formation, rapid drying, uniform drying, soil detachment, self-cleaning, lower spot formation, reduction of the resoilability, cleaner appearance, improved shine, etc. The surface is coated fully or partly with the composition. After the drying, under air or by heating etc., and/or the curing, the surface has been modified permanently or at least for a prolonged period.

The prior art thus already knows some compositions which are capable of solving some of the problems addressed. However, it is desirable to modify, by means of a cleaning composition, a surface to be cleaned in such a way that the wetting and runoff behavior of water firstly changes in such a way as to result in a planar, rapid-drying film which does not break in the course of drying or tend to the form "runs". Secondly, the tendency to be subject to resoiling and to condensation should be lowered.

It is therefore an object of the invention to provide a cleaning composition for hard surfaces, especially glass, by which the surface to be cleaned is wetted over the full surface and dries rapidly, and also shows a low tendency to be subject to condensation and resoiling.

It has been found that cleaning compositions to which certain colloidal, nanoparticulate silica sols have been added bring about a change of the streaming potential of the clean surface toward more negative values, and that surfaces cleaned with such compositions are wetted over the full surface, dry uniformly without the formation of "runs" and are subject to condensation or soiling less rapidly.

The invention accordingly provides a cleaning composition for hard surfaces, especially glass, comprising a colloidal silica sol, characterized in that its use results in a change in the streaming potential of the surface by from −5 to −50 mV, compared with an untreated surface.

The use of these cleaning compositions preferably hydrophilicizes the surface, which leads to a long-lasting wettability of the surface as a flat film. As a result of this, the soil particles are distributed uniformly and do not form any "runs", so that the appearance of the clean surface is clean over a prolonged period. These effects, and also the lower resoiling tendency and the anticondensation action, can preferably be observed over a prolonged period after the use of the composition, for example for three weeks. However, there is no desire for a permanent modification of the surface. Finally, the cleaning composition to be used should satisfy the customary technical and also esthetic requirements for a cleaning composition for hard surfaces; in particular, the composition in a preferred embodiment should be transparent and also be suitable for spraying and have a good cleaning performance.

Colloidal nanoparticulate silica sols in the context of this invention are stable dispersions of amorphous particulate silicon dioxide $SiO_2$ with particle sizes in the range from 1 to 100 nm. The particle sizes are preferably in the range from 3 to 50 nm, more preferably from 4 to 40 nm. One example of a silica sol which is suitable for use in the context of this invention is the silica sol which is obtainable from Akzo under the trade name Bindzil® 30/360 and has a particle size of 9 nm. Further suitable silica sols are Bindzil® 15/500, 30/220, 40/200, 257/360 (Akzo), Nyacol® 215, 830, 1430, 2034DI and Nyacol® DP5820, DP5480, DP5540 etc. (Nyacol products), Levasil® 100/30, 100F/30, 100S/30, 200/30, 200F/30, 300F/30, VP 4038, VP 4055 (H. C. Starck/Bayer) or else CAB-O-SPERSE® PG 001, PG 002 (aqueous dispersions of CAB-O-SIL®, Cabot), Quartron PL-1, PL-3 (FusoChemical Co.), Köstrosol 0830, 1030, 1430 (Chemiewerk Bad Köstritz).

The silica sols used may also be surface-modified silica which has been treated with sodium aluminate (alumina-modified silica).

However, not every colloidal silica sol is suitable as an inventive additive. It has been found that the silica sols which can be used in the context of the invention are only those whose use brings about an increase in the average microroughness by from at least 5 nm to at most 30 nm and a change in the streaming potential by from at least −5 mV to at most −50 mV on the clean surface, in each case compared with an untreated surface. The microroughness is a parameter familiar to those skilled in the art and is measurable by atomic force microscopy (AFM). It refers to the deviation in distance from an ideal smooth surface and is measured in μm or nm.

It has also been found to be advantageous when the hydrophilicizing particles are adsorbed on the surface in such a way that the surface is covered to an extent of from 10 to 75%; correspondingly, another at least 25% of free surface should remain.

The inventive composition may further also comprise surface-active substances. Suitable surface-active substances for the inventive compositions are surfactants, in particular from the classes of the anionic and nonionic surfactants. The compositions preferably comprise anionic surfactants. The amount of anionic surfactant is typically not more than 10% by weight, preferably between 0.01 and 5% by weight, in particular between 0.01 and 1% by weight, for example 0.5% by weight. When the compositions comprise nonionic surfactants, their concentration is typically not more than 3% by weight, preferably between 0.001 and 0.3% by weight and in particular between 0.001 and 0.1% by weight. In a preferred embodiment, the inventive composition is, however, free of nonionic surfactants. It has further been found to be particularly advantageous when the surfactant content overall in the ready-to-use composition is not more than 6% by weight. When the composition is provided as a concentrate for dilution before use, the surfactant content overall is preferably not more than 15% by weight, more preferably from 1 to 12% by weight, in particular from 2 to 10% by weight.

Suitable anionic surfactants are preferably $C_8$-$C_{18}$-alkylbenzenesulfonates, in particular having about 12 carbon atoms in the alkyl moiety, $C_8$-$C_{20}$-alkanesulfonates, $C_8$-$C_{18}$-monoalkyl sulfates, $C_8$-$C_{18}$-alkyl polyglycol ether sulfates having from 2 to 6 ethylene oxide units (EO) in the ether moiety, and mono- and di-$C_8$-$C_{18}$-alkyl sulfosuccinates. In addition, it is also possible to use $C_8$-$C_{18}$-α-olefinsulfonates, sulfonated $C_8$-$C_{18}$ fatty acids, in particular dodecylbenzenesulfonate, $C_8$-$C_{22}$ carboxamide ether sulfates, $C_8$-$C_{18}$-alkyl polyglycol ether carboxylates, $C_8$-$C_{18}$ N-acyltaurides, $C_8$-$C_{18}$ N-sarcosinates and $C_8$-$C_{18}$-alkyl isethionates and mixtures thereof.

The anionic surfactants are preferably used in the form of sodium salts, but may also be present in the form of other alkali metal or alkaline earth metal salts, for example magnesium salts, and in the form of ammonium or mono-, di-, tri- or tetraalkylammonium salts, in the case of the sulfonates also in the form of their corresponding acid, for example dodecylbenzenesulfonic acid.

Examples of such surfactants are sodium cocoalkylsulfate, sodium sec-alkanesulfonate having approx. 15 carbon atoms and sodium dioctylsulfosuccinate. It has been found that fatty alkyl sulfates and fatty alkyl +2EO ether sulfates having from 12 to 14 carbon atoms are particularly suitable.

As nonionic surfactants, mention should be made in particular of $C_8$-$C_{18}$-alcohol polyglycol ethers, i.e. ethoxylated and/or propoxylated alcohols having from 8 to 18 carbon atoms in the alkyl moiety and from 2 to 15 ethylene oxide (EO) and/or propylene oxide units (PO), $C_8$-$C_{18}$ carboxylic acid polyglycol esters having from 2 to 15 EO, for example tallow fatty acid +6 EO ester, ethoxylated fatty acid amides having from 12 to 18 carbon atoms in the fatty acid moiety and from 2 to 8 EO, long-chain amine oxides having from 14 to 20 carbon atoms and long-chain alkyl polyglycosides having from 8 to 14 carbon atoms in the alkyl moiety and from 1 to 3 glycoside units. Examples of such surfactants are oleyl cetyl alcohol having 5 EO, nonylphenol having 10 EO, lauric acid diethanolamide, cocoalkyl dimethylamine oxide and cocoalkyl polyglucoside having on average 1.4 glucose units. Particular preference is given to fatty alcohol polyglycol ethers having in particular from 2 to 8 EO, for example $C_{12-14}$ fatty alcohol +4 EO ether.

$C_8$-$C_{18}$-Alkyl alcohol polypropylene glycol/polyethylene glycol ethers constitute preferred known nonionic surfactants. They are described by the formula I, $R^iO—(CH_2CH(CH_3)O)_p(CH_2CH_2O)_e—H$, in which $R^i$ is a linear or branched, aliphatic alkyl and/or alkenyl radical having from 8 to 18 carbon atoms, p is 0 or numbers from 1 to 3 and e is numbers from 1 to 20.

The $C_8$-$C_{18}$-alkyl alcohol polyglycol ethers of the formula I may be obtained by adding propylene oxide and/or ethylene oxide onto alkyl alcohols, preferably onto fatty alcohols. Typical examples are polyglycol ethers of the formula I in which $R^i$ is an alkyl radical having from 8 to 18 carbon atoms, p is from 0 to 2 and e is numbers from 2 to 7. Preferred representatives are, for example, $C_{10}$-$C_{14}$ fatty alcohol+1PO+6EO ether (p=1, e=6) and $C_{12}$-$C_{18}$ fatty alcohol+7EO ether (p=0, e=7) and mixtures thereof.

It is also possible to use end group-capped $C_8$-$C_{18}$-alkyl alcohol polyglycol ethers, i.e. compounds in which the free OH group in the formula I is etherified. The end group-capped $C_8$-$C_{18}$-alkyl alcohol polyglycol ethers may be obtained by relevant methods of preparative organic chemistry. Preference is given to reacting $C_8$-$C_{18}$-alkyl alcohol polyglycol ethers with alkyl halides, in particular butyl or benzyl chloride, in the presence of bases. Typical examples are mixed ethers of the formula I in which $R^i$ is a technical fatty alcohol radical, preferably $C_{12/14}$-cocoalkyl radical, p is 0 and e is from 5 to 10, which are capped with a butyl group.

Preferred nonionic surfactants are also alkylpolyglycosides (APGs) of the formula II, $R^{ii}O[G]_x$, in which $R^{ii}$ is a linear or branched, saturated or unsaturated alkyl radical having from 8 to 22 carbon atoms, [G] is a glycosidically linked sugar residue and x is a number from 1 to 10. APGs are nonionic surfactants and are known substances which can be obtained by the relevant processes of preparative organic chemistry. The index x in the general formula II specifies the degree of oligomerization (average degree of polymerization), i.e. the distribution of mono- and oligoglycosides, and is a number between 1 and 10. While x in a given compound always has to be a whole number and can assume here in particular the values of x=1 to 6, the value x for a particular alkylglycoside is an analytically determined theoretical parameter which is usually a fractional number. Preference is given to using alkylglycosides having an average degree of oligomerization x of from 1.1 to 3.0. From an application point of view, preference is given to those alkylglycosides whose degree of oligomerization is less than 1.7 and in particular between 1.2 and 1.6. The glycosidic sugar used is preferably xylose, but in particular glucose.

The alkyl or alkenyl radical $R^{ii}$ (formula II) may derive from primary alcohols having from 8 to 18, preferably from 8 to 14, carbon atoms. Typical examples are caproic alcohol, caprylic alcohol, capric alcohol and undecyl alcohol and their technical-grade mixtures, as are obtained, for example, in the course of the hydrogenation of technical-grade fatty acid methyl esters or in the course of the hydrogenation of aldehydes from the ROELEN oxo process.

However, the alkyl or alkenyl radical $R^{ii}$ preferably derives from lauryl alcohol, myristyl alcohol, cetyl alcohol, palmoleyl alcohol, stearyl alcohol, isostearyl alcohol or oleyl alcohol. Mention should also be made of elaidyl alcohol, petroselinyl alcohol, arachidyl alcohol, gadoleyl alcohol, behenyl alcohol, erucyl alcohol and their technical-grade mixtures.

As further nonionic surfactants, nitrogen-containing surfactants may be present, for example fatty acid polyhydroxy amides, for example glucamides, and ethoxylates of alkylamines, vicinal diols and/or carboxamides which have alkyl groups having from 10 to 22 carbon atoms, preferably from 12 to 18 carbon atoms. The degree of ethoxylation of these compounds is generally between 1 and 20, preferably between 3 and 10. Preference is given to ethanolamide derivatives of alkanoic acids having from 8 to 22 carbon atoms, preferably from 12 to 16 carbon atoms. The particularly suitable compounds include the lauric acid monoethanolamides, myristic acid monoethanolamides and palmitic acid monoethanolamides.

Compositions which contain anionic and nonionic surfactants, in particular combinations of fatty alkyl sulfates and/or fatty alcohol polyglycol ether sulfates with fatty alcohol polyglycol ethers, are also particularly preferred.

In addition to the surfactant types mentioned hitherto, the inventive composition may further also comprise cationic surfactants and/or amphoteric surfactants.

Suitable amphosurfactants are, for example, betaines of the formula $(R^{iii})(R^{iv})(R^{v})N^{+}CH_2COO^{-}$, in which $R^{iii}$ is an alkyl radical which is optionally interrupted by heteroatoms or heteroatom groups and has from 8 to 25, preferably from 10 to 21, carbon atoms, and $R^{iv}$ and $R^{v}$ are identical or different alkyl radicals having from 1 to 3 carbon atoms, in particular $C_{10}$-$C_{18}$-alkyldimethylcarboxymethylbetaine and $C_{11}$-$C_{17}$-alkylamidopropyldimethylcarboxymethylbetaine. The compositions contain amphoteric surfactants in amounts, based on the composition, of from 0 to 10% by weight.

Suitable cationic surfactants include the quaternary ammonium compounds of the formula $(R^{vi})(R^{vii})(R^{viii})(R^{ix})N^{+}X^{-}$ in which $R^{vi}$ to $R^{ix}$ are four identical or different, in particular two long-chain and two short-chain, alkyl radicals and $X^{-}$ is an anion, in particular a halide ion, for example didecyldimethylammonium chloride, alkylbenzyldidecylammonium chloride and mixtures thereof. The compositions comprise cationic surfactants in amounts, based on the composition, of from 0 to 10% by weight.

In a particularly preferred embodiment, the composition comprises, as the surfactant component, however, only one or more anionic surfactants, preferably $C_8$-$C_{18}$-alkyl sulfates and/or $C_8$-$C_{18}$-alkyl ether sulfates, and/or one or more nonionic surfactants.

In addition, the inventive cleaning compositions may comprise water-soluble organic solvents, for example lower alcohols and/or ether alcohols, but preferably mixtures of different alcohols and/or ether alcohols. Lower alcohols in the context of this invention are straight-chain or branched $C_{1-6}$-alcohols. The amount of organic solvent is typically not more than 50% by weight, preferably from 0.1 to 30% by weight, in particular from 0.5 to 15% by weight, exceptionally preferably from 1 to 10% by weight.

The alcohols used are in particular ethanol, isopropanol and n-propanol. Useful ether alcohols are sufficiently water-soluble compounds having up to 10 carbon atoms in the molecule. Examples of such ether alcohols are ethylene glycol monobutyl ether, propylene glycol monobutyl ether, diethylene glycol monobutyl ether, propylene glycol monotert-butyl ether and propylene glycol monoethyl ether, of which preference is given in turn to ethylene glycol monobutyl ether and propylene glycol monobutyl ether. When alcohol and ether alcohol are used together, the weight ratio of the two is preferably between 1:2 and 4:1. When, in contrast, mixtures of two different ether alcohols, in particular ethylene glycol monobutyl ether and propylene glycol monobutyl ether, are used, the weight ratio of the two is preferably between 1:6 and 6:1, in particular between 1:5 and 5:1, for example 4:1, the proportion of the ether alcohol having fewer carbon atoms preferably being the higher of the two.

In addition, the inventive compositions may comprise volatile alkali. The volatile alkalis used may be ammonia and/or alkanolamines which contain up to 9 carbon atoms in the molecule. Preferred alkanolamines are the ethanolamines and of these in turn monoethanolamine. The content of ammonia and/or alkanolamine is preferably from 0.01 to 3% by weight, in particular from 0.02 to 1% by weight, more preferably from 0.05 to 0.75% by weight.

In addition to the volatile alkali, alkaline compositions may additionally comprise carboxylic acid, the equivalents ratio of amine and/or ammonia to carboxylic acid preferably being between 1:0.9 and 1:0.1. Suitable carboxylic acids have up to 6 carbon atoms, and may be mono-, di- or polycarboxylic acids. Depending on the equivalents ratio of amine and carboxylic acid, the content of carboxylic acid is preferably between 0.01 and 2.7% by weight, in particular between 0.01 and 0.9% by weight. Examples of suitable carboxylic acids are acetic acid, glycolic acid, lactic acid, citric acid, succinic acid, adipic acid, malic acid, tartaric acid and gluconic acid, of which preference is given to using acetic acid, citric acid and lactic acid. Particular preference is given to using acetic acid.

Inventive acidic cleaning compositions may also comprise acids instead of volatile alkali. Suitable acids are in particular organic acids such as the carboxylic acids already mentioned above, acetic acid, citric acid, glycolic acid, lactic acid, succinic acid, adipic acid, malic acid, tartaric acid and gluconic acid, or else amidosulfonic acid. In addition, it is also possible to use the mineral acids hydrochloric acid, sulfuric acid and nitric acid or mixtures thereof. Particular preference is given to acids selected from the group comprising amidosulfonic acid, citric acid and formic acid. They are used preferably in amounts of from 0.1 to 5% by weight, more preferably from 0.5 to 4% by weight, in particular from 1 to 3% by weight.

In addition, the inventive acidic cleaning compositions may also comprise small amounts of bases. Preferred bases stem from the group of the alkali metal and alkaline earth metal hydroxides and carbonates, in particular the alkali metal hydroxides, of which particular preference is given to potassium hydroxide and in particular to sodium hydroxide. In the acidic compositions, bases are used in amounts of not more than 1% by weight, preferably from 0.01 to 0.1% by weight.

The composition preferably has a Brookfield viscosity (model DV-II+, spindle 31, rotational frequency 20 $min^{-1}$, 20° C.) of from 0.1 to 200 mPa.s, in particular from 0.5 to 100 mPa.s, exceptionally preferably from 1 to 60 mPa.s. For this purpose, the composition may comprise viscosity regulators. The amount of viscosity regulator is typically up to 0.5% by weight, preferably from 0.001 to 0.3% by weight, in particular from 0.01 to 0.2% by weight, exceptionally preferably from 0.05 to 0.15% by weight.

Suitable viscosity regulators are, for example, organic natural thickeners (agar-agar, carrageenan, tragacanth, gum Arabic, alginates, pectins, polyoses, guar, gu, locust bean gum, starch, dextrins, gelatin, casein), organically modified natural substances (carboxymethylcellulose and other cellulose ethers, hydroxyethyl-and-propylcellulose and the like, gum ethers), organic fully synthetic thickeners (polyacrylic and polymethacrylic compounds, vinyl polymers, polycarboxylic acids, polyethers, polyimines, polyamides) and inorganic thickeners (polysilicic acids, clay minerals such as montmorillonites, zeolites, silicas).

The polyacrylic and polymethacrylic compounds include, for example, the high molecular weight homopolymers of acrylic acid which have been crosslinked with a polyalkenyl polyether, in particular an allyl ether of sucrose, pentaerythritol or propylene (INCI designation according to International Dictionary of Cosmetic Ingredients from The Cosmetic, Toiletry and Fragrance Association (CTFA): Carbomer), which are also referred to as carboxyvinyl polymers. Such polyacrylic acids are obtainable, inter alia, from 3V Sigma under the trade name Polygel®, e.g. Polygel® DA, and from BF Goodrich under the trade name Carbopol®, e.g. Carbopol® 940 (molecular weight approx. 4 000 000), Carbopol® 941 (molecular weight approx. 1 250 000) or Carbopol® 934 (molecular weight approx. 3 000 000). These also include the following acrylic acid copolymers: (i) copolymers of two or more monomers from the group of acrylic acid, methacrylic acid and their simple esters, preferably formed with $C_{1-4}$-alkanols (INCI acrylates copolymer), which include, for instance, the copolymers of methacrylic acid, butyl acrylate and methyl methacrylate (CAS designation according to Chemical Abstracts Service: 25035-69-2) or of butyl acrylate and methyl methacrylate (CAS 25852-37-3), and which are obtainable, for example, from Rohm & Haas under the trade names Aculyn® and Acusol®, and from Degussa (Goldschmidt) under the trade name Tego® Polymer, for example the anionic nonassociative polymers Aculyn® 22, Aculyn® 28, Aculyn® 33 (crosslinked), Acusol® 810, Acusol® 823 and Acusol® 830 (CAS 25852-37-3); (ii) crosslinked high molecular weight acrylic acid copolymers which include, for instance, the copolymers of $C_{10-30}$-alkyl acrylates with one or more monomers from the group of acrylic acid, methacrylic acid, and their simple esters, preferably formed with $C_{1-4}$-alkanols, which have been crosslinked with an allyl ether of sucrose or of pentaerythritol (INCI acrylates/C10-30 alkyl acrylate crosspolymer), and which are obtainable, for example, from BF Goodrich under the trade name Carbopol®, for example the hydrophobicized Carbopol® ETD 2623 and Carbopol® 1382 (INCI acrylates/C10-30 alkyl acrylate crosspolymer) and Carbopol® AQUA 30 (formerly Carbopol® EX 473). The international application WO 97/38076 lists a series of polymers which are derived from acrylic acid and constitute suitable viscosity regulators.

Further thickeners are the polysaccharides and heteropolysaccharides, especially the polysaccharide gums, for example gum Arabic, agar, alginates, carrageenans and their salts, guar, guaran, tragacanth, gellan, ramsan, dextran or xanthan and derivatives thereof, for example propoxylated guar, and mixtures thereof. Other polysaccharide thickeners, such as starches or cellulose derivatives, may be used alternatively, but preferably additionally, to a polysaccharide gum, for example starches from a wide variety of origins and starch derivatives, for example hydroxyethyl starch, starch phosphate esters or starch acetates, or carboxymethylcellulose or its sodium salt, methyl-, ethyl-, hydroxyethyl-, hydroxypropyl-, hydroxypropylmethyl- or hydroxyethylmethylcellulose or cellulose acetate. A particularly preferred polysaccharide thickener is the microbial anionic heteropolysaccharide xanthan gum which is produced by *Xanthomonas campestris* and some other species under aerobic conditions and has a molecular weight of $2\text{-}15\times10^6$, and is obtainable, for example, from Kelco under the trade names Keltrol® and Kelzan® or else from Rhodia under the trade name Rhodopol®.

The thickeners used may also be layered silicates. These include, for example, the magnesium or sodium-magnesium layered silicates from Solvay Alkali which are obtainable under the trade name Laponite®, in particular Laponite® RD or else Laponite® RDS, and also the magnesium silicates from Süd-Chemie, in particular Optigel® SH.

In the selection of the suitable viscosity regulator, it should be ensured that the transparent appearance of the cleaning composition is retained, i.e. the use of the thickener should not lead to opacification of the composition.

In one embodiment, the inventive cleaning composition may also be formulated as a higher-viscosity liquid. In that case, the viscosity is between 200 and 1000 mPa.s (Brookfield viscometer DV-II+, small sample adaptor). The content of viscosity regulator (thickener) may in these cases be up to 2% by weight.

In addition to the components mentioned, the inventive compositions may comprise further adjuvants and additives as are customary in such compositions. These include in particular dyes, perfume oils, preservatives, complexing agents for alkaline earth metal ions, enzymes, bleach systems and antistats. In addition, polymers, in particular copolymers, for example the Sokalans® obtainable from BASF, for instance Sokalan® CP 9, the sodium salt of a maleic acid-olefin copolymer, may be used for surface modification.

The amount of such additives is typically not more than 2% by weight in the cleaning composition. The lower limit of use depends on the type of additive and may, for example in the case of dyes, be up to 0.001% by weight and below. The amount of assistants is preferably between 0.01 and 1% by weight.

The pH of the inventive compositions may be varied over a wide range, but preference is given to a range of from 2.5 to 12. Glass cleaner formulations and all-purpose cleaners have in particular a pH of from 6 to 11, most preferably from 7 to 10.5, and bath cleaners have in particular a pH of from 2 to 5, exceptionally preferably of from 2.5 to 4.0.

The inventive compositions are preferably formulated in ready-to-use form. A formulation as a concentrate to be diluted appropriately before use is likewise possible in the context of the inventive teaching, in which case the ingredients are present in the upper region of the ranges specified in each case.

The inventive compositions may be prepared directly from their raw materials by mixing, subsequently mixing thoroughly and finally leaving the composition to stand until it is free of bubbles.

The inventive compositions are preferably used for glass cleaning, both for windows and for mirrors and other glasses. However, they may also be used to clean hard surfaces, in particular in the case of surfaces which are occasionally or frequently flushed with dirty or else clean water, for example showers, baths and floors in bathrooms or else kitchen surfaces. A further field of use of inventive compositions is in rinse aids for machine dishwashers. However, textile surfaces may also experience hydrophilicization by the use of inventive compositions. Yet a further field of use is the hydrophilicization of surfaces in the automobile sector, both of automotive paint systems and of automotive windows. The inventive composition may of course also be used for coatings in general, and metal surfaces can also be hydrophilicized with them.

As used herein, and in particular as used herein to define the elements of the claims that follow, the articles "a" and "an" are synonymous and used interchangeably with "at least one" or "one or more," disclosing or encompassing both the singular and the plural, unless specifically defined otherwise. The conjunction "or" is used herein in its inclusive disjunctive sense, such that phrases formed by terms conjoined by "or" disclose or encompass each term alone as well as any combination of terms so conjoined, unless specifically defined otherwise. All numerical quantities are understood to be modified by the word "about," unless specifically modified otherwise or unless an exact amount is needed to define the invention over the prior art.

EXAMPLES

The inventive alkaline glass cleaners E1 to E3 and the alkaline comparative composition C1, and also the inventive acidic bath cleaners E4 to E6 and the acidic comparative composition C2 were prepared by simply stirring together the components according to Tables 1 and 2. E1 to E3 and E4 to E6 contained the inventive nanoparticulate silica sol, while C1 and C2 did not have any additive. All compositions were clear and colorless.

In the examples, the following raw materials were used:

| | |
|---|---|
| fatty alcohol sulfate sodium salt: | sodium lauryl sulfate (Texapon ® LS 35, Cognis) |
| fatty alcohol ether sulfate sodium salt: | sodium laureth sulfate (Texapon ® N70, Cognis) |
| hydroxyethylcellulose: | Natrosol ® HHBR (Hercules) |
| nanoparticulate silica sol: | alkaline cleaner: Bindzil ® 30/360 (Akzo) |
| | acidic cleaner: Bindzil ® CAT 80 (Akzo) |

TABLE 1 alkaline glass cleaners

| | Composition [% by wt.] | | | |
|---|---|---|---|---|
| | E1 | E2 | E3 | C1 |
| Fatty alcohol sulfate sodium salt | 0.5 | 0.5 | 0.5 | 0.5 |
| Ethanol | 3 | 3 | 3 | 3 |

TABLE 1-continued alkaline glass cleaners

| | Composition [% by wt.] | | | |
|---|---|---|---|---|
| | E1 | E2 | E3 | C1 |
| Monoethanolamine | 0.5 | — | 0.2 | — |
| Ammonia | — | 0.3 | 0.2 | 0.3 |
| Nanoparticulate silica sol | 0.2 | 0.2 | 0.2 | — |
| Perfume | 0.01 | 0.01 | 0.01 | 0.01 |
| Acetic acid | — | 0.02 | 0.05 | 0.02 |
| Water | ad 100 | ad 100 | ad 100 | ad 100 |

These glass cleaners were used to clean window panes which were subsequently exposed to the weather over two weeks. Panes which had been treated with the inventive cleaners E1 to E3, even two weeks later, still exhibited the formation of a spreading, planar film when wetted with water. The residue was formed in the form of very finely distributed particles, so that the pane has a visually clean appearance.

The pane treated with the comparative composition C1, in contrast, exhibited the formation of drops when wetted with water as early as after two days did an untreated glass pane. The residue was formed in the form of "runs", so that the pane had a soil appearance.

TABLE 2 acidic bath cleaners

| | Composition [% by wt.] | | | |
|---|---|---|---|---|
| | E4 | E5 | E6 | C2 |
| Fatty alcohol sulfate sodium salt | 0.5 | 0.5 | 0.5 | 0.5 |
| Ethanol | 3 | 3 | 3 | 3 |
| Citric acid | 1 | 1 | 3 | 1 |
| EDTA | — | 0.2 | — | — |
| Nanoparticulate silica sol | 0.2 | 0.2 | 0.2 | — |
| Perfume | 0.01 | 0.01 | 0.01 | 0.01 |
| Sodium hydroxide solution | — | 0.02 | 0.05 | 0.02 |
| Water | ad 100 | ad 100 | ad 100 | ad 100 |

These cleaners were used to clean bathroom tiles. Afterward, the tiles were sprayed once per day with water (15° German hardness) over two weeks. The tiles treated with the inventive compositions E4 to E6, even after two weeks, still exhibited the formation of a spreading, flat film when wetted with water. The residue was formed in the form of very finely distributed particles, so that the tiles had a visually clean appearance.

The tiles treated with the comparative composition C2, in contrast, exhibited the formation of drops when wetted with water, as early as after two days, as did untreated tiles. The residue was formed in the form of "runs", so that the tiles had a soiled appearance.

Testing of anticondensation and antirain effect The glass cleaners E1 to E3 and the comparative composition C1 were subsequently examined for their anticondensation and antirain effect:

initially, on a mirror of size 30 cm×60 cm, in each case 2 ml of the particular composition were distributed with a folded cloth of total size 20 cm×20 cm (Chicopee, Duralace 60) and polished out in the manner customary in practice. After 30 minutes, a second, identical treatment was effected. A further 30 minutes later, the anticondensation and antirain effect were in each case tested as follows.

Anticondensation effect. The treated mirror was held over a dish (28 cm×50 cm×4 cm) containing 1.5 l of boiling water for 5 seconds and rated immediately thereafter as to whether and, if appropriate, to what extent there was condensation on the mirror.

Antirain effect. By means of a pumpspray bottle, approx. 10 g of test rain prepared from tap water and 8 g/l of wfk carpet pigment soil (55% by weight of kaolin, 43% by weight of quartz, 1.5% by weight of lamp black 101, 0.5% by weight of iron oxide black; wfk code wfk-09 W) from wfk-Testgewebe GmbH (http://www.wfk.de), were sprayed uniformly onto the pretreated mirror surface within about 4 seconds. Directly thereafter, wetting and drop formation were rated and, after drying, soil distribution and spot formation.

The rating was done in each case visually by a panel of five people, by each person assigning in each case the position 1 to 4 in the sequence of decreasing effect to the four compositions. The particular average is reported as a mark together with an assessment in Table 3. The lower the mark, the better the particular effect was.

TABLE 3

| Effect Composition | Mark | Assessment |
|---|---|---|
| Anticondensation effect | | |
| E1 | 3 | low action |
| E2 | 2 | good protection from condensation |
| E3 | 1 | very good action |
| C1 | 4 | no anticondensation effect |
| Antirain effect | | Overall impression of the wet pane |
| E1 | 2.4 | good wetting, few drops |
| E2 | 1.8 | very good wetting, hardly any drops |
| E3 | 1.6 | very good wetting, no drops |
| C1 | 4.0 | good wetting, breaks rapidly |
| Antirain effect | | Overall impression of the dry pane |
| E1 | 2.8 | somewhat better soil distribution than C1 |
| E2 | 1.8 | soil distributed uniformly, hardly any spots |
| E3 | 1.6 | soil distributed uniformly, no spots |
| C1 | 4.0 | some spots and "runoff traces", soil uniform only in the upper section |

In contrast to C1, the compositions E1 to E3 exhibit both an antirain effect and an anticondensation effect.

Analogously to the inventive compositions E1 to E3, the comparative compositions C3 to C5 were also prepared according to Table 4 on the basis of C1 as a framework formulation using the poly(sodium p-styrenesulfonate) polymer known as an antirain additive. These alkaline compositions too were clear and colorless.

TABLE 4

| | Additive [% by wt.] | | |
|---|---|---|---|
| | C3 | C4 | C5 |
| Poly (sodium p-styrenesulfonate), 70 000 g/mol | 0.1 | 0.2 | 0.4 |

As described above, the compositions C3 to C5 were also tested for an anticondensation effect. In contrast to the inventive compositions E1 to E3, the compositions C3 to C5 did not, however, exhibit an anticondensation effect.

Comparative Experiments

Some experiments were carried out in order to delimit silica sols which can be used in accordance with the invention from those which cannot be used in accordance with the invention. Firstly, microroughnesses and streaming potentials and contact angle (for water and ethylene glycol) of surfaces treated with different additives were measured, but investigations were also carried out on runoff behavior and on long-term effectiveness. In each case, an identical glass cleaner base was used and the specified amount of the particular additive was added.

1. Surface Roughness (Microroughness)

The surface roughness at the micrometer level was analyzed with the aid of an atomic force microscope (AFM; Nanoscope III). To this end, a white test tile (Villeroy & Boch WC Ceramic) was cleaned with the aid of Pril solution and subsequently ethanol, and sprayed with a 1% solution of the particular additive in a glass cleaner base, and the moist tile was rubbed dry with the aid of a paper towel. The thus treated tile was analyzed in the AMF.

| Average microroughness [nm] | before coating | after coating |
|---|---|---|
| Additive 1 (Bindzil 30/360) | 10 | 17 |
| Additive 2 (Bindzil CAT 80) | 6 | 28 |
| Additive 3* (Nanogate LSraB 0212) | 9 | 12 |
| Additive 4* (Klebosol 20 H 12) | 8 | 11 |
| Additive 5* (Klebosol 30 N 12) | 6 | 9 |
| Additive 6* (Klebosol 30 R 12) | 9 | 10 |

*noninventive

The increase in the microroughness facilitates detachment of soil in parallel with the hydrophilization. The microroughness should accordingly be increased by from at least 5 nm to at most 30 nm in order to achieve the desired hydrophilicization effect. An increase in the roughness by only 3 nm is not sufficient. In the case of an increase by more than 30 nm, it is no longer guaranteed that there will be no residue or streaks.

2. Streaming Potential

The streaming potential of treated tiles was analyzed with the aid of an EKA instrument (Anton Paar ElektroKinetikAnalyser). To this end, a white test tile (Villeroy & Boch WC Ceramic) was cleaned with the aid of Pril solution and subsequently ethanol, and sprayed with a 1% solution of the particular additive in a glass cleaner base, and the moist tile was rubbed dry with the aid of a paper towel. The thus treated tile was analyzed in the EKA instrument at 200 mbar and with 0.001 mol KCl as the electrolyte.

| Streaming potential [mV] | after coating |
|---|---|
| Uncoated tile | −32 |
| Additive 1 (Bindzil 30/360) | −61 |
| Additive 2 (Bindzil CAT 80) | −48 |
| Additive 3* (Nanogate LSraB 0212) | −23 |
| Additive 4* (Klebosol 20 H 12) | −34 |
| Additive 5* (Klebosol 30 N 12) | −36 |
| Additive 6* (Klebosol 30 R 12) | −28 |

*noninventive

The change in the negative streaming potential proves the hydrophilicization owing to the increased contribution of the surface charge. The streaming potential should accordingly change by from at least −5 mV to at most −50 mV in order to achieve the desired hydrophilicization effect. A change in the streaming potential by less than −5 mV does not bring about sufficient hydrophilicization. In the event of a change by more than −50 mV, the surface energy is increased so greatly that the tendency to resoiling increases. This is, for example, also the case for colloidal $TiO_2$ particles.

3. Runoff Behavior

A black standard test tile (Villeroy & Boch Bath Ceramic, 18×12 cm) is sprayed with the particular test product. The moist tile is rubbed dry with the aid of a paper towel. Subsequently, the tile is wetted fully by immersion in deionized water and then brought into a vertical position. A camcorder is used to film the drying tile. With the aid of visual image processing, the dry surface area is calculated as a percentage of the surface area of the tile. It is thus possible to monitor the progress of drying with time.

The following result was obtained:

| | Time [min] until 90% surface area 95% surface area has dried | |
|---|---|---|
| 1. (Glass cleaner base) | 10.8 | 12.0 |
| 2. (Base with 0.6% Bindzil 30/360 + N) | 10.0 | 10.9 |
| 3. (Base with 2% Nanogate LSraB 0212) | 9.3 | 9.9 |
| 4. (Base with 0.6% Bindzil 30/360) | 8.7 | 9.2 |
| 5. (Base with 0.3% Bindzil 30/360) | 7.9 | 8.4 |

(N = nonionic surfactant: end group-capped fatty alcohol alkoxylate)

The runoff behavior with addition of Bindzil 30/360 leads to the best result at lower use concentrations. The shorter drying time leads to a directly visible advantage for the consumer.

4. Long-Term Effectiveness

The different formulations which have already been used in the investigation of the runoff behavior are applied to free-standing window surfaces of size 1×2 m which are exposed to the weather. A panel of 5 experts evaluates the apparent cleanliness of the panes daily. Marks of 1 (no soiling) to 6 (strong soiling) are given. As the days pass, a statement on the durability is obtained from the averages of the marks.

| | Time in days | | | | | | | |
|---|---|---|---|---|---|---|---|---|
| | 1 | 2 | 3 | 5 | 10 | 15 | 20 | 25 |
| Form. 1 | 1 | 1.4 | 1.6 | 2.2 | 3.0 | 4.2 | 5.2 | 5.4 |
| Form. 2 | 1 | 1.2 | 1.4 | 1.8 | 2.4 | 3.6 | 4.2 | 4.8 |
| Form. 3 | 1 | 1.2 | 1.4 | 2.0 | 2.6 | 3.6 | 4.4 | 4.8 |
| Form. 4 | 1 | 1.4 | 1.4 | 1.6 | 1.8 | 3.0 | 3.8 | 4.2 |
| Form. 5 | 1 | 1.2 | 1.6 | 1.6 | 2.0 | 3.2 | 4.0 | 4.4 |

5. Contact Angle

The contact angle of treated tiles for water and ethylene glycol was determined with the aid of drop contour analysis (Krüss DSA 10 contact angle measuring instrument). To this end, a white test tile (Villeroy & Boch WC Ceramic) was cleaned with the aid of Pril solution and subsequently ethanol, and sprayed with a 1% solution of the particular additive in a glass cleaner base, and the moist tile was rubbed dry with the aid of a paper towel. The contact angle of water or ethylene glycol on the thus treated tile was determined.

The following result was obtained:

| Contact angle [°] | for $H_2O$ | for ethylene glycol |
|---|---|---|
| Uncoated tile | 33 | 7 |
| Additive 1 (Bindzil 30/360) | 10 | 18 |
| Additive 2 (Bindzil CAT 80) | 14 | 14 |
| Additive 3 (Nanogate LSraB 0212) | 8 | 11 |

The lowering of the contact angle for water and the simultaneous increase in the contact angle for ethylene glycol proves the hydrophilicization of the surface. The noninventive Nanogate additive 3 increases the contact angle for ethylene glycol only insufficiently. The contact angle should accordingly be reduced by at least 15° for water in order to achieve the desired hydrophilicization effect. The contact angle for ethylene glycol should, in contrast, be increased by at least 5°.

The measurements of the microroughness and of the streaming potentials already demonstrate that not every silica sol is suitable for the inventive use in cleaning compositions for the hydrophilicization of surfaces. In addition, a degree of coverage of the surface of from 10 to 75% is advantageous, i.e., even after adsorption of the hydrophilicizing particles, at least 25% free surface should remain. In contrast to this, the silica sol from Nanogate (additive 3, LSraB 0212), for example, achieved a degree of coverage of over 90%. The coverage was measured with the aid of an atomic force microscope (AFM; Nanoscope III) and visual image evaluation.

A further criterion is the ability to be incorporated into a colorless, translucent, stable product. Some commercially available silica sols cannot fulfill this criterion. For instance, the Klebosol types 30H 25 and 30 V 25 purchasable from Clariant are opaquely visible in the product. Klebosol 30 V 50, just like the Baykisol 30 obtainable from Bayer, is a white slurry which is opaquely visible in the product and does not allow a stable formulation. The colloidal silica sols used in the document EP 1 215 276 which has already been mentioned in the introduction are therefore unsuitable for the inventive use. The same applies to the silica sol from Merck, used in the likewise cited German application DE 100 21 726, which corresponds to Syton HT-50 from DuPont: this colloidal silica too, having a particle size of 40 nm, is opaquely visible in the product.

Also in accordance with the invention are the three examples which follow, of concentrates to be diluted before use. In this case, the composition should be diluted preferably in a ratio of from 1:1 to 1:100 with water; particular preference is given to a dilution in the ratio of 1:10.

TABLE 5

Glass cleaner concentrate

| | Composition [% by wt.] | | |
|---|---|---|---|
| | E7 | E8 | E9 |
| Fatty alcohol sulfate | 8.00 | 8.00 | 8.00 |
| Fatty alcohol ether sulfate | 2.00 | 2.00 | 2.00 |
| Hydroxyethylcellulose | 0.30 | 0.30 | 0.30 |
| Sodium hydroxide 45% | 0.05 | 0.05 | 0.05 |
| Dye | 0.008 | 0.008 | 0.008 |
| Perfume | 0.070 | 0.070 | 0.070 |
| Ethanol | 5.00 | 5.00 | 5.00 |
| Nanopart. silica sol 30% | 3.0 | 2.0 | 1.0 |
| Water, demin. | 81.57 | 82.57 | 83.57 |
| PH | 10.5 | 10.5 | 10.5 |
| Viscosity [mPas] | 150 | 150 | 150 |

What is claimed is:

1. A method of cleaning a hard surface comprising the steps of contacting a hard surface in need of cleaning with a cleaning-effective amount of a composition comprising:

(a) an anionic surfactant selected from the group consisting of C8-18 alkylbenzenesulfonates, C8-20 alkanesulfonates, C8-18 fatty alcohol sulfates, C8-18 alkyl polyglycol ether sulfates, mono- and di-C8-18 alkyl sulfosuccinates, and any salts and/or mixtures thereof;

(b) a nonionic surfactant selected from the group consisting of C8-18 alcohol polyglycol ethers, C8-18 carboxylic acid polyglycol esters, ethoxylated fatty acid amides, C14-20 amine oxides, alkylpolyglycosides, and any mixtures thereof;

(c) a colloidal silica sol comprised of hydrophilicizing particles that produces a change in streaming potential of a hard surface treated therewith of −5 to −50 mV relative to the untreated surface; and (d) at least one volatile alkali selected from the group consisting of ammonia, alkanolamines having up to 9 carbon atoms, and mixtures thereof wherein the viscosity of the cleaning composition is from 0.1 to 200 mPa.s.

2. The method of claim 1, wherein the silica has a particle size of 1 to 100 nm.

3. The method of claim 2, wherein the silica has a particle size of 3 to 50 nm.

4. The method of claim 3, wherein the silica has a particle size of 4 to 40 nm.

5. The method according to claim 1 wherein the cleaning composition is hydrophilic.

6. The method according to claim 1 wherein the cleaning composition is transparent.

7. The method of claim 1, wherein the cleaning composition has average microroughness increasing properties.

8. The method of claim 1, wherein the cleaning composition has soil release and/or resoiling inhibition properties.

9. The method of claim 1, wherein the cleaning composition produces rapid and uniform drying of a surface after rewetting.

10. The method of claim 1, wherein the cleaning composition has anti-condensation action, and/or anti-rain effect.

11. The method of claim 1, wherein the cleaning composition further comprises at least one water-soluble organic solvent.

12. The method of claim 1, wherein the cleaning composition further comprises one or more lower alcohols, ether alcohols, or any mixture thereof.

13. The method of claim 1, wherein the cleaning composition further comprises at least one carboxylic acid selected from the group consisting of acetic acid, glycolic acid, lactic acid, citric acid, succinic acid, adipic acid, malic acid, tartaric acid, gluconic acid, and mixtures thereof.

14. The method of claim 1, wherein the cleaning composition further comprises one or more viscosity regulators selected from the group consisting of organic natural thickeners, organic modified natural substances, organic fully synthetic thickeners, inorganic thickeners, and mixtures thereof.

15. The method of claim 1, wherein the cleaning composition further comprises one or more additives selected from the group consisting of dyes, perfume oils, preservatives, complexing agents for alkaline earth metal ions, enzymes, bleaching systems, antistats, and mixtures thereof.

16. The method of claim 1, wherein the cleaning composition has a viscosity of 0.5 to 100 mPa.s.

17. The method of claim 16, wherein the cleaning composition has a viscosity of 1 to 60 mPa.s.

18. The method of claim 1, wherein the cleaning composition has a pH of from 2.5 to 12.

* * * * *